US006091368A

United States Patent [19]

Mitchell et al.

[11] Patent Number: 6,091,368

[45] Date of Patent: Jul. 18, 2000

[54] DEVICE FOR MAKING RF AND DATA CONNECTION TO A SATELLITE SUBSCRIBER UNIT

[75] Inventors: Jay R. Mitchell, Mesa; James L. Isbell, Phoenix, both of Ariz.; Michael S. Horn, Longmont, Colo.

[73] Assignee: Motorola, Inc., Schaumburg, Ill.

[21] Appl. No.: 09/080,761

[22] Filed: May 18, 1998

[51] Int. Cl.[7] ..... H01Q 1/24

[52] U.S. Cl. ..... 343/702; 343/906; 455/562; 455/575; 455/90; 379/455

[58] Field of Search ..... 343/702, 906; 455/562, 575, 90, 351, 129; 379/455

[56] References Cited

U.S. PATENT DOCUMENTS

| | | | |
|---|---|---|---|
| 5,559,522 | 9/1996 | Seitz | 343/702 |
| 5,901,367 | 5/1999 | Toh | 455/575 |
| 5,949,378 | 9/1999 | Coveley | 343/702 |

OTHER PUBLICATIONS

Patent Application 29/080,864, filed Dec. 18, 1997, Hallis, George et al., Motorola, "Communication Device", 3 pages.

*Primary Examiner*—Don Wong
*Assistant Examiner*—James Clinger
*Attorney, Agent, or Firm*—Lalita P. Williams

[57] ABSTRACT

An accessory (100) for docking a handset (1010) of a SSU and providing a connection to the SSU's antenna (1210) or a different antenna. The accessory (100) includes a first power/data connector (115) and the handset (1010) includes a second power/data connector (1014). The accessory (100) also includes a rotating rotating antenna coupler (130) whereby when the coupler (130) is in a first position, the handset (1010) can be placed in a recess (112) of the accessory (100) and coupled to a first connector (320). When the coupler (130) is rotated to a second position, the handset (1010) moves in a direction perpendicular to the coupler's axis of rotation until the second power/data connector (1014) mates with the first power/data connector (115), thereby locking the handset (1010) in the accessory (100). Once the handset (1010) is locked in the accessory (100), an antenna (1210) can be connected to a second connector (340) in the coupler (130).

15 Claims, 10 Drawing Sheets

FIG. 4
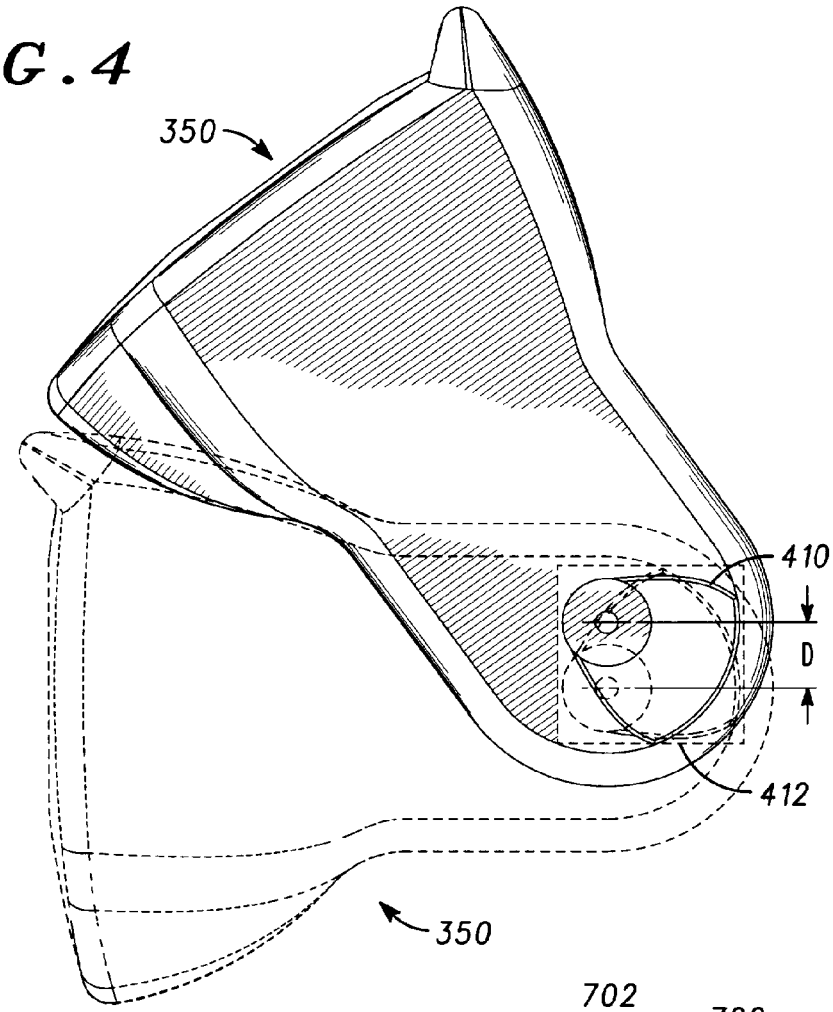
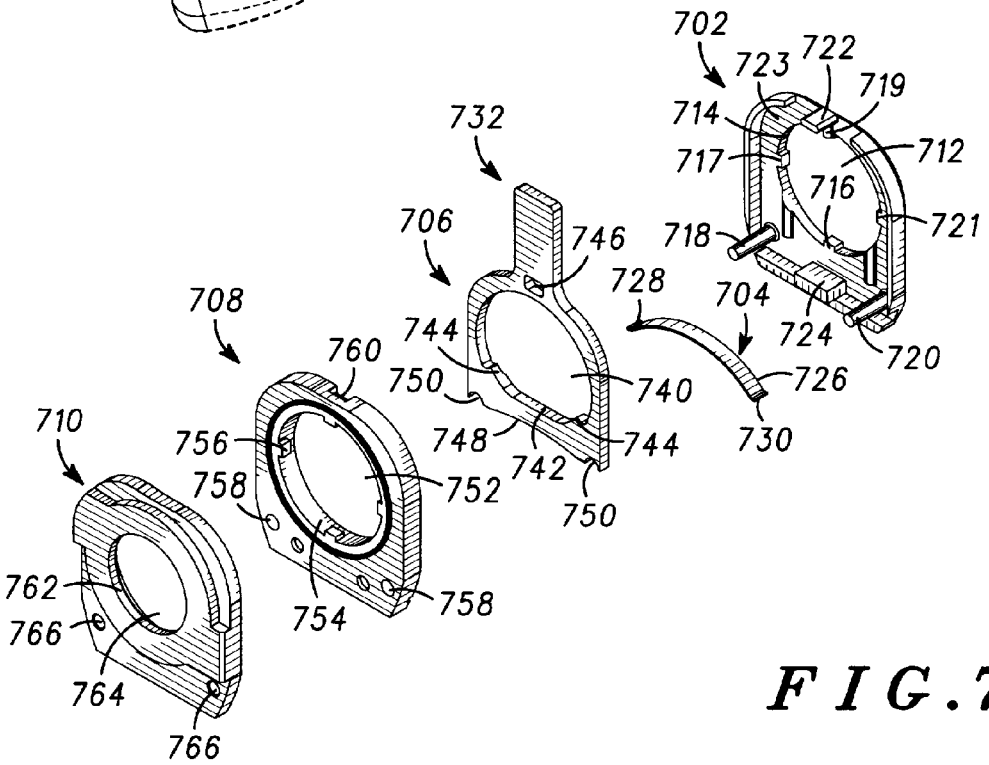
FIG. 7

DEVICE FOR MAKING RF AND DATA CONNECTION TO A SATELLITE SUBSCRIBER UNIT

FIELD OF THE INVENTION

The present invention relates generally to the field of mechanical connectors, and more particularly to connectors for making radio frequency (RF) and data connections. Although, the invention is subject to a wide range of applications, it is especially suited for use in an accessory for a satellite subscriber unit (SSU), and will be particularly described in that connection.

BACKGROUND OF THE INVENTION

A cellular radiotelephone system consists of a number of base stations and radiotelephone handsets. The user receives and places radiotelephone calls through the handset, which is in radio communication with one of the base stations.

A satellite radio communication system, such as the IRIDIUM® system, has a network of satellites in a low earth polar orbit, each satellite performing the same function as a base station. The satellites transmit and receive signals from a satellite subscriber unit (SSU) to form a radiotelephone system, allowing users to place radiotelephone calls from anywhere in the world to anywhere else in the world.

A SSU designed for use in the IRIDIUM® system is described in U.S. Pat. No. 5,559,522 ('552 patent), issued on Sep. 14, 1996 and assigned to Motorola, Inc. The '552 patent describes an SSU having an antenna that rotates from an inactive position with respect to the handset to an active position with respect to the handset. Because of the rotating feature of the antenna with respect to the handset, a robust RF connection between the antenna port of the handset and the antenna is necessary in order for the SSU to operate properly during a call.

As the world's communications needs continue to grow, there is a corresponding need for a satellite radio communication system that supports advanced features such as speaker phone capability, data communications, upgradeable antenna, and multiple power configurations. Thus, a need exists for a docking accessory incorporating these advanced features, in which the SSU can be used.

BRIEF DESCRIPTION OF THE DRAWINGS

FIG. 4 is a rear view of the rotating antenna coupler mating with the docking accessory wherein a cam feature for moving the coupler from an unrotated position (shown in dotted lines) to a rotated position (shown in solid lines) is illustrated.

FIG. 7 is an exploded view of the antenna latch detent mechanism shown in FIG. 3.

SUMMARY OF THE PREFERRED EMBODIMENT

One aspect of the present invention provides an antenna coupler having a top housing forming a first opening; a first connector at least partially extending through the opening; a second connector coupled to the first connector; an antenna latch detent mechanism coupled to the second connector; and a bottom housing that mates with the top housing in a manner which forms a bore in which the second connector is at least partially received.

Another aspect of the present invention provides an accessory, having a first power/data connector, for docking a handset of a subscriber unit and providing connection to an antenna, the handset having a second power/data connector, the accessory including an upper housing having a first recess; an antenna coupler rotatably coupled to the upper housing; and a lower housing coupled to the antenna coupler and the upper housing.

The present invention provides a unique way of providing an RF connection to the antenna port of the SSU handset while simultaneously making power/data connections between the handset and the accessory. Once the power/data connection between the handset and the accessory has been made, the original SSU antenna, a different antenna, or a low loss cable to an external antenna may be coupled to the handset. Also, after the power/data connection has been made, the present invention locks the handset into the accessory to prevent theft or loss.

DESCRIPTION OF THE PREFERRED EMBODIMENT

The following detailed description is exemplary and explanatory only and is not restrictive of the invention as claimed. The accompanying drawings illustrate the preferred embodiment of the invention and together with the description serve to explain the principles of the invention. Reference will now be made in detail to the present preferred embodiment of the invention.

Figure 1:
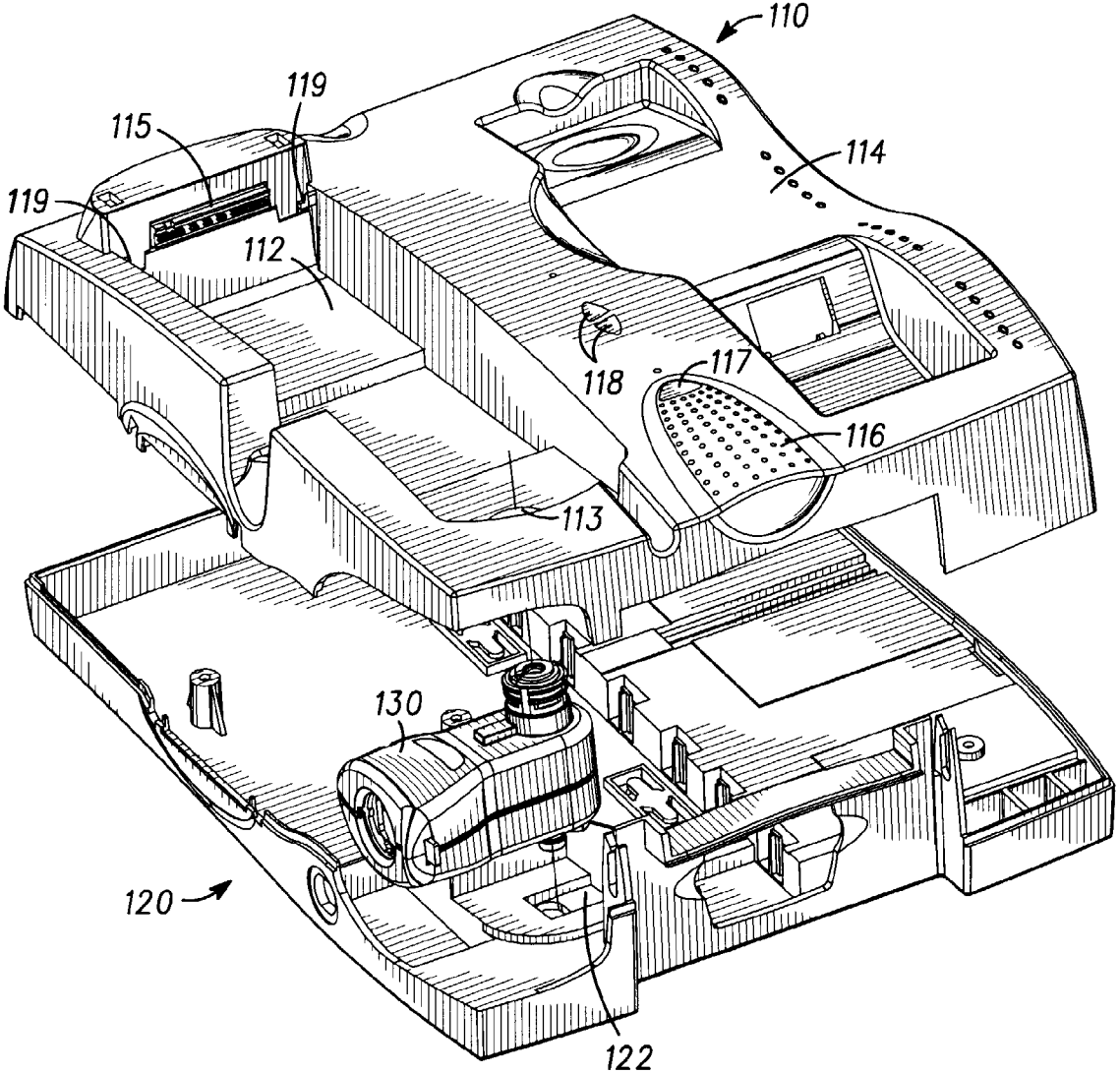
FIG. 1 is an exploded view of a satellite subscriber unit docking accessory with which the preferred embodiment of the rotating antenna coupler of the present invention can be used.

FIG. 1 is an exploded view of an SSU docking accessory 100 that can employ the rotating antenna coupler 130 of the present invention. Although use with an SSU is described herein, the present invention can be used with any radiotelephone having a removable antenna that rotates with respect to the handset. The accessory 100 is used to convert a portable SSU into a desktop SSU. The accessory 100 includes an upper housing 110 that mates with a lower housing 120. Preferably, the housings 110, 120 are injection molded using polycarbonate. The upper housing 110 includes a first recess 112 for docking the SSU (not shown) and a second recess 114 for docking a passive handset for private communication (not shown).

The first recess 112 includes a slot 113 for receiving at least part of the rotating antenna coupler 130. A first power/data connector 115 is disposed in the first recess 112. The first power/data connector 115 mates with a second power data/connector (reference numeral 1014 in FIG. 10) of the SSU handset 1010 when the handset 1010 is docked and locked into the recess 112. The operation of docking the handset 1010 is described in detail later herein. The accessory 100 supports features such as a speakerphone 116 for teleconferencing, a mute button 117 for preventing parties on the other end of a call from hearing conversation taking place in the room where the accessory 100 is located, and up and down arrow keys 118 for volume control.

Disposed between the upper housing 110 and the lower housing 120 is the preferred embodiment of the rotating antenna coupler 130 of the present invention. The coupler is used to provide a robust connection between the SSU handset 1010 and the SSU antenna (reference numeral 1210 in FIG. 12) or between the SSU and a low loss cable, which in turn is connected to an external antenna. Alternatively, the coupler 130 can provide a direct connection between the SSU and an external antenna. The coupler 130 also provides a robust connection between the first power/data connector 115 of the accessory 100 and the second power/data connector of the SSU handset (reference numeral 1010 in FIG. 10).

Figure 2:
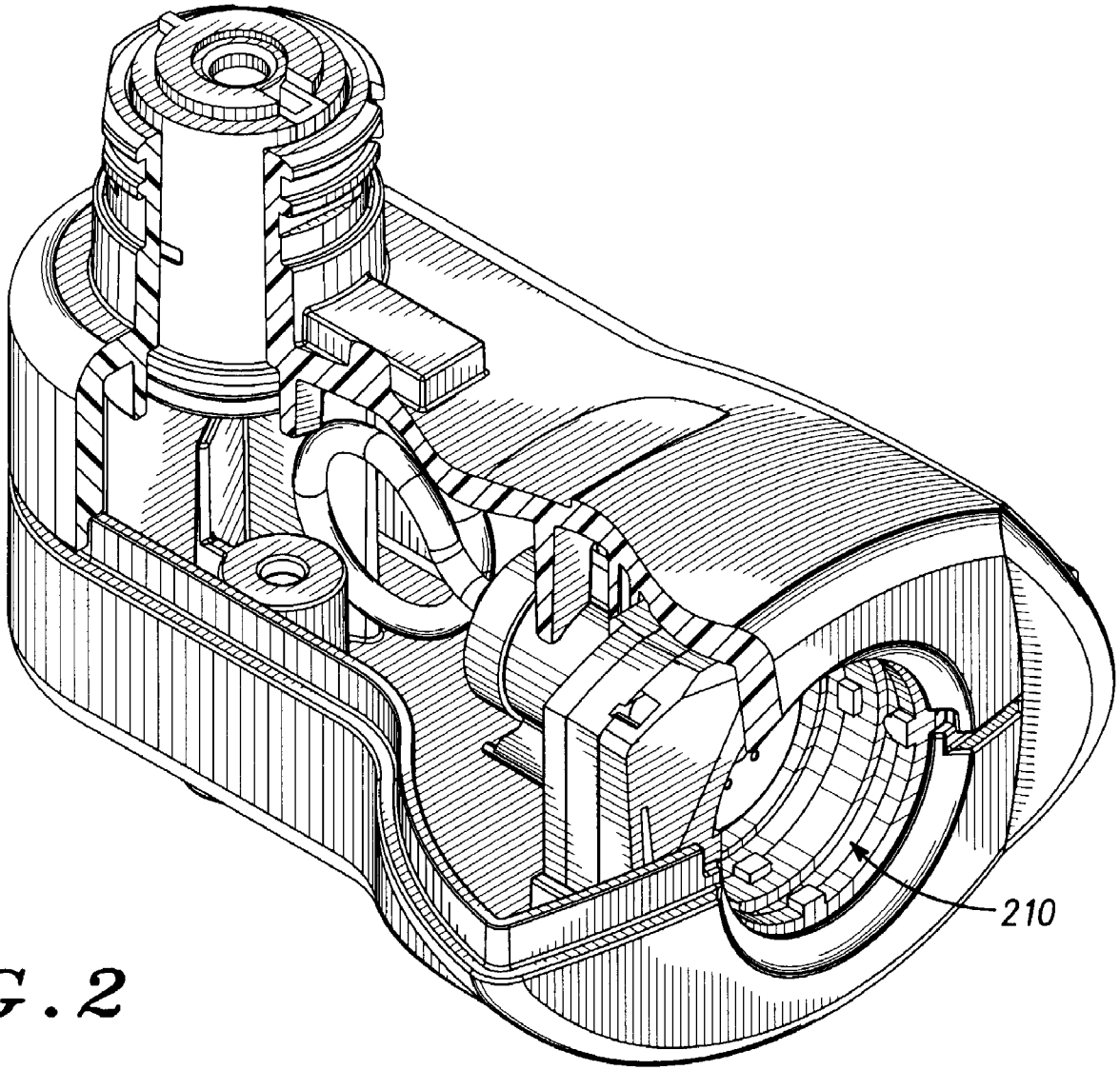
FIG. 2 is a perspective view of the rotating antenna coupler shown in FIG. 1.
Figure 3:
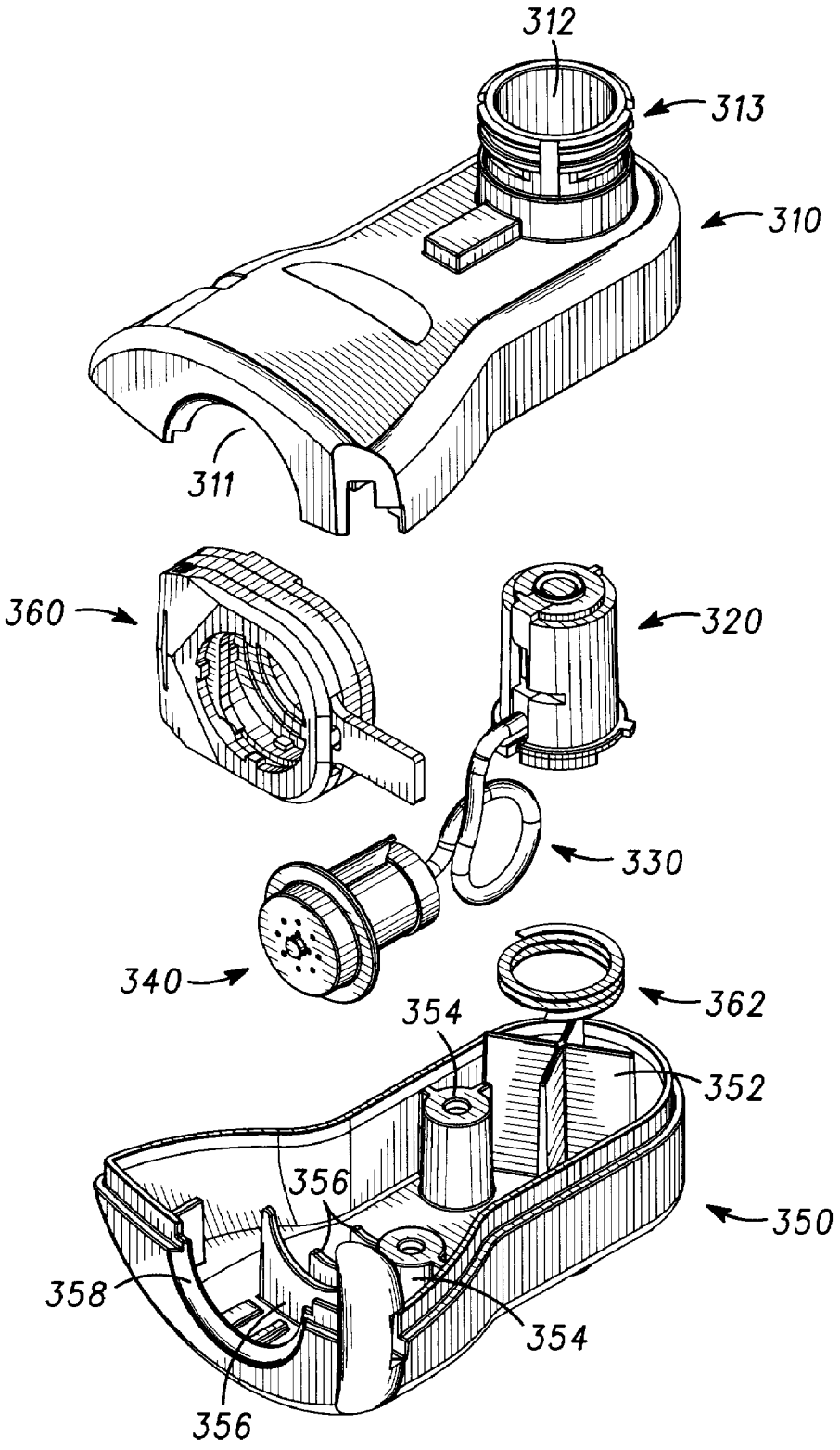
FIG. 3 is an exploded view of the rotating antenna coupler shown in FIG. 2.

The coupler 130 is shown in detail in FIGS. 2 and 3. With reference to FIG. 3, the rotating coupler 130 includes a top housing 310 and a bottom housing 350, both preferably injection molded from a plastic material that possesses good wear and dielectric properties, such as polycarbonate. Within the housings 310, 350 are a first connector 320 and a second connector 340 preferably interconnected by a semi-rigid coaxial cable 330 soldered at each end to the respective connector 320, 340. Also within the housings 310, 350 and coupled to the second connector 340 is an antenna latch detent mechanism 360 for maintaining the position of the SSU's antenna 1210 or an external antenna in an inactive (or stowed) position and a stowed position. The antenna latch detent mechanism 360 is disposed between the top housing 310 and bottom housing 350 as shown in FIG. 2 and held in place when the housings 310, 350 are fastened together. The second connector 340 protrudes partially into the mechanism 340 and is held relative to the mechanism 340 by ribs 356 (FIG. 3).

The coupler's top housing 310 preferably forms a socket 313 about an opening 312, through which the first connector 320 is disposed. Formed on an end of the top housing 310 opposite the opening 321 is an arch-like opening 311. The arch-like opening 311 mates with a similar arch-like opening 358 formed on an end of the bottom housing 350 to form a bore 210 (FIG. 2) in which the antenna latch detent mechanism 360 and at least part of the second connector 340 is received. The bottom housing 350 also includes a lattice of integral plastic walls 352 for supporting a compression spring 362 and the first connector 320; a plurality of screw bosses 354 that mate with screw bosses (not shown) in the top housing 310 for keeping the top and bottom housings 310, 350 together; and a plurality of ribs 356 that mate with similar ribs (not shown) on the top housing 310 for supporting the second connector 340.

Figure 6:
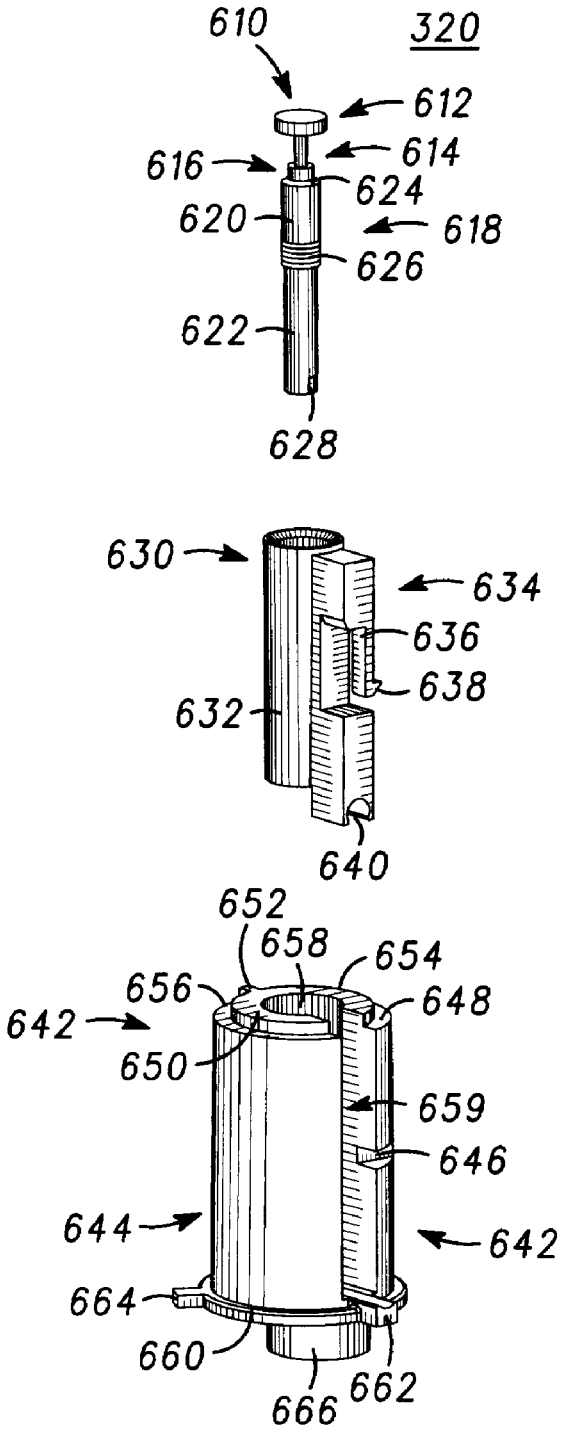
FIG. 6 is an exploded view of the first connector shown in FIG. 3.

Referring to FIG. 6, an exploded view of the first connector 320 is shown. The first connector 320 includes a center conductor 610, a dielectric 630 and an outer conductor 642. The center conductor 610 is preferably comprised of brass and includes a cylindrical head 612; a tubular neck 614 coupled to the head 612; a circular collar 616 coupled to the neck 614; and a body 618 having an upper portion 620 and a lower portion 622. A vertically-extending aperture (not shown) is formed through the collar 616 and at least partially through the body 618. A spring (not shown) is disposed in the aperture so that when pressure is applied to the top of the head 612, the neck 614 compresses the spring when it moves down into the aperture.

The upper portion 620 of the center conductor body 618 is preferably beveled on one end 624 and includes a barbed region 626 at an opposite end. The lower portion 622 of the center conductor body 618 forms a rectangular shaped transversely extending aperture 628 for soldering to a center conductor of a coaxial 330 (FIG. 3).

The dielectric 630 is preferably injection molded using Ultem 2300 and includes a generally cylindrical portion 632 coupled to a substantially rectangular portion 634. The rectangular portion 634 includes an arm 636 forming a tab 638 at a bottom end thereof. The tab 638 is coupled to the outer conductor 642 (described below) during assembly of the first connector 320. Formed at the bottom end of the rectangular portion 634 is a transversely-extending arch 640 for allowing passage of the coaxial cable 330 to the center conductor 610.

Figure 10:
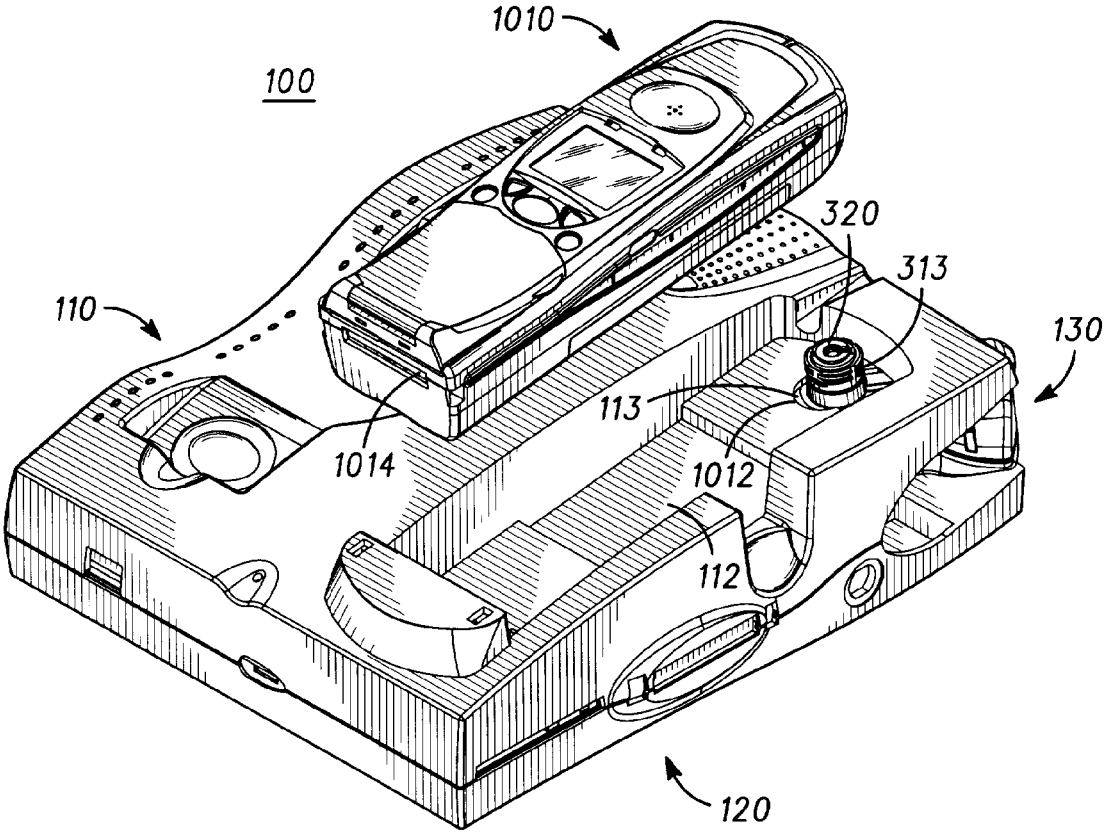
FIG. 10 is a perspective view of the docking accessory with the coupler in the unrotated position.

The outer conductor 642 is preferably injection molded using LCP plastic. The outer conductor 642 includes a cylindrical body 644 having an inner diameter and an outer diameter. Formed on an outer surface of the body 644 and extending into the body 644 is a slit 646 for receiving the tab 638 of the dielectric 630 during assembly of the first connector 320. Disposed at a top end 648 of the body 644 is a ring 650 having an outer diameter less than the outer diameter of the body 644. The ring 650 forms a finger 652 that extends from an outer surface 654 of the ring 650 to an outer surface 656 of the body 644. Formed about a central axis of the ring 650 and body 644 is a cavity 658 that extends from the top surface of the ring 650 through to the bottom surface of the body 644. Adjacent the cavity 658 is a slot 659 which extends from the top surface of the ring 650 to the bottom surface of the body 644. Disposed at a bottom end of the body 644 is a disc 660 having a diameter greater than the outer diameter of the body 644. Formed on the disc 660 and extending into the slot 659 is a trough 662 for receiving the coaxial cable 330 (FIG. 3) and soldering the outer jacket of the cable 330 thereto. Also formed on the disc 660 is a plurality of locating tabs 664 (only one shown) for stabilizing the first connector 320 inside the socket 313 of coupler 130. Coupled to a bottom side of the disc 660 is a spring guide 666 for maintaining a second spring 362 (FIG. 3). The second spring (362) is used to help maintain a robust connection between the first connector 320 and a connector (not shown) in the SSU handset 1010 (FIG. 10).

During assembly of the first connector 320, the center conductor 610 is preferably press fitted into the dielectric 630 according to a specified interference fit. The dielectric 630, with center conductor 610 therein, is then disposed in the center conductor's cavity 658. The tab 638 formed at the end of the arm 636 of the dielectric 630 fits into the slit 646 formed on the outer conductor 642 to maintain the positioning of the dielectric 630 (and center conductor 610) in the cavity 658.

The antenna latch detent mechanism 360 shown in FIG. 3 mates with an antenna stem 800 of the SSU (shown in FIG. 8) when the antenna 1210 (FIG. 12) is connected to the coupler 130. FIG. 7 shows an exploded view of the antenna latch detent mechanism 360 (hereinafter "mechanism"). The mechanism 360 includes a top plate 702; a plurality of leaf springs 704, preferably two (only one shown); a latch member 706; a middle plate 708 and a bottom plate 710. Preferably, the top plate 702, middle plate 708 and bottom plate 710 are comprised of polycarbonate; the leaf springs 704 are comprised of stainless steel and the latch member 706 is comprised of aluminum.

The top plate 702 is preferably arch-shaped and defines a first cylindrical hole 712 having a diameter slightly greater than the diameter of the first raised wall 806 (FIG. 8) of the antenna stem 800 for receiving the wall 806. Disposed on an interior surface 714 of the top plate 702 is a plurality of keys 716, 717, 710, 721, preferably four. The spacing of the keys 716, 717, 719, 721 on the interior surface 714 is such that the keys are received in key receptacles 802, 804, 806, 808 (FIG. 8) of the antenna stem 800 when the stem 800 mates with the mechanism 360. Specifically, a first key 716 is centered at the bottom of the interior surface 714; a second key 717 is centered around a point on the interior surface 90° from the center of the first key 716, a third key 719 is centered around a point on the interior surface 90° from the center of the second key 717; and fourth key 721 is centered around a point on the interior surface 90° from the center of the third key 719. The top plate 702 also includes a first post 718, a second post 720, a tab 722 and a rectangular block 724 disposed on the inner surface 723 of the top plate 702.

During assembly of the mechanism 360, the plurality of leaf springs 704 are coupled on one side 726 to a bottom portion of the inner surface 723 of the top plate 702. One end 728 of the leaf springs 704 is disposed under the first post 718 and the other end 730 is disposed under the second post 720, leaving the middle portion of the springs 704 situated above the rectangular block 724.

Figure 8:
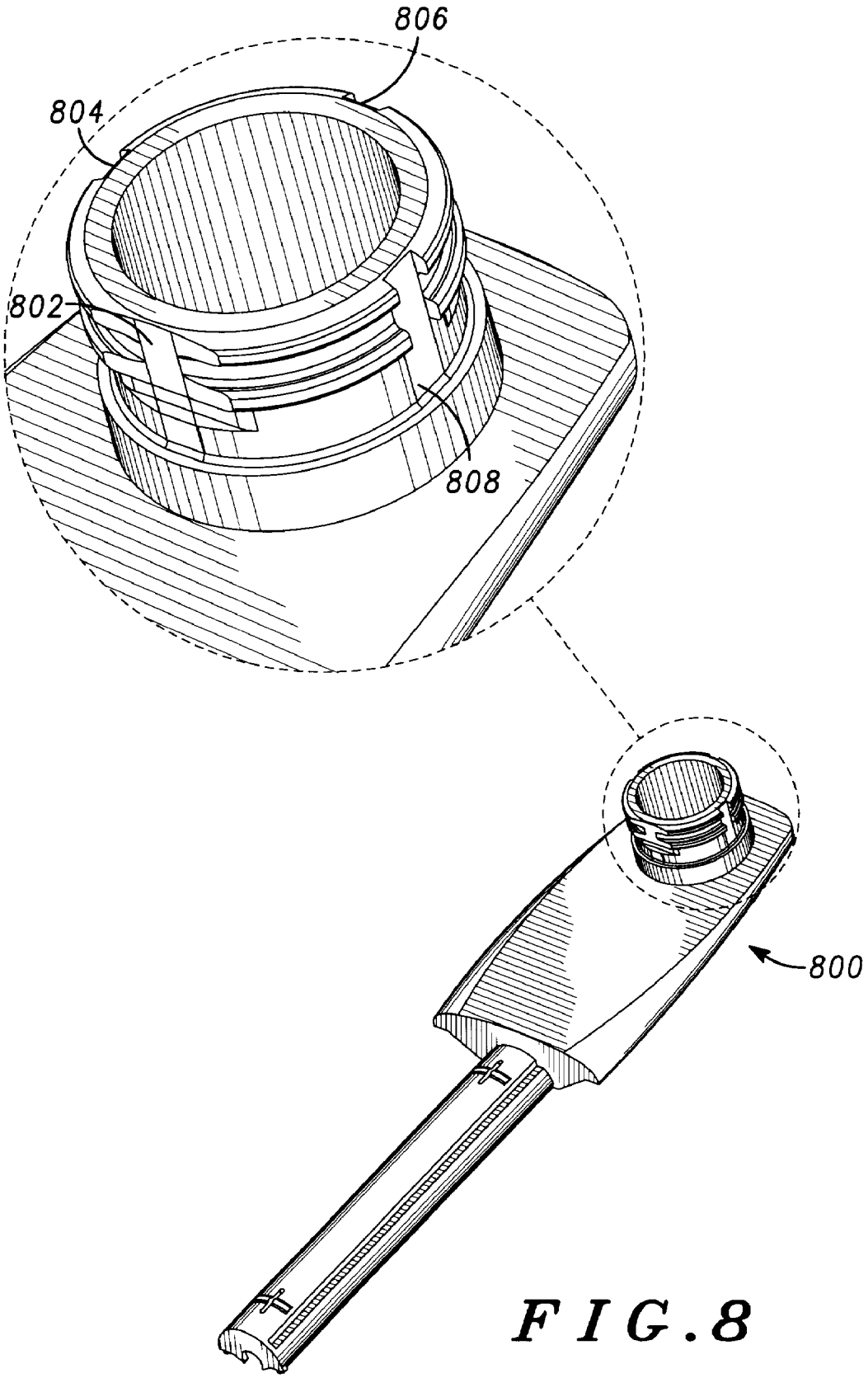
FIG. 8 is a perspective view of an antenna stem that mates with the antenna latch detent mechanism of FIG. 7.

The latch member 706 is generally arch shaped having a rectangular portion 732 at the top, and defines a second cylindrical hole 740. The hole 740 is such that the member 706 defines a flat portion 742 and two curved portions 744 about the hole 740. Located adjacent the second cylindrical hole 740 is an opening 746 for receiving the tab 722 of the top plate 702 when the latch member 706 is coupled to the inner surface 723 thereof. The bottom surface 748 of the latch member 706 is slightly curved having an arch shaped aperture 750 at both ends of the surface 748. The slightly curved bottom surface 748 of the latch member 706 mates with the top of the leaf springs 704 when the latch member 706 is coupled to the top plate 702. At the same time, the arch shaped apertures 750 are suspended above the posts 718, 720 of the top plate 702 as shown in FIG. 8.

The middle plate 708 is preferably arch-shaped and defines a third cylindrical hole 752 having a diameter slightly greater than the first raised wall 806 of the antenna stem 800 for receiving the wall 806. Disposed on an interior surface 754 of the middle plate 708 is a plurality of keys 756, preferably four. The spacing of the keys 756 on the interior surface 754 of the middle plate 708 is the same as the spacing of the keys 716, 717, 719, 721 on the top plate 702. The middle plate 708 also includes two apertures 758 and a rectangular notch 760. The two apertures 758 are for receiving the posts 718, 720 disposed on the inner surface 723 of the top plate 702. The notch 760 is for receiving the tab 722 disposed on the inner surface 723 of the top plate 702.

The bottom plate 710 is preferably arch-shaped and defines a recess 762 having a diameter of the first and third cylindrical holes 712, 752 of the top and middle plates 702, 708, respectively. The front surface 226 (FIG. 2) of the first raised wall 806 is disposed in the recess when the antenna stem 800 is coupled to the mechanism 360. Formed in the recess 762 is a fourth cylindrical hole 764 through which the second connector 340 and an antenna connector (not shown) mate when the antenna 1210 is connected to the coupler 130. The bottom plate 710 also includes two apertures 766 for receiving the posts 718, 720 disposed on the inner surface 723 of the top plate 702, and includes a plurality of mounting tabs 768 for coupling the mechanism 360 to the coupler housing.

Figure 12:
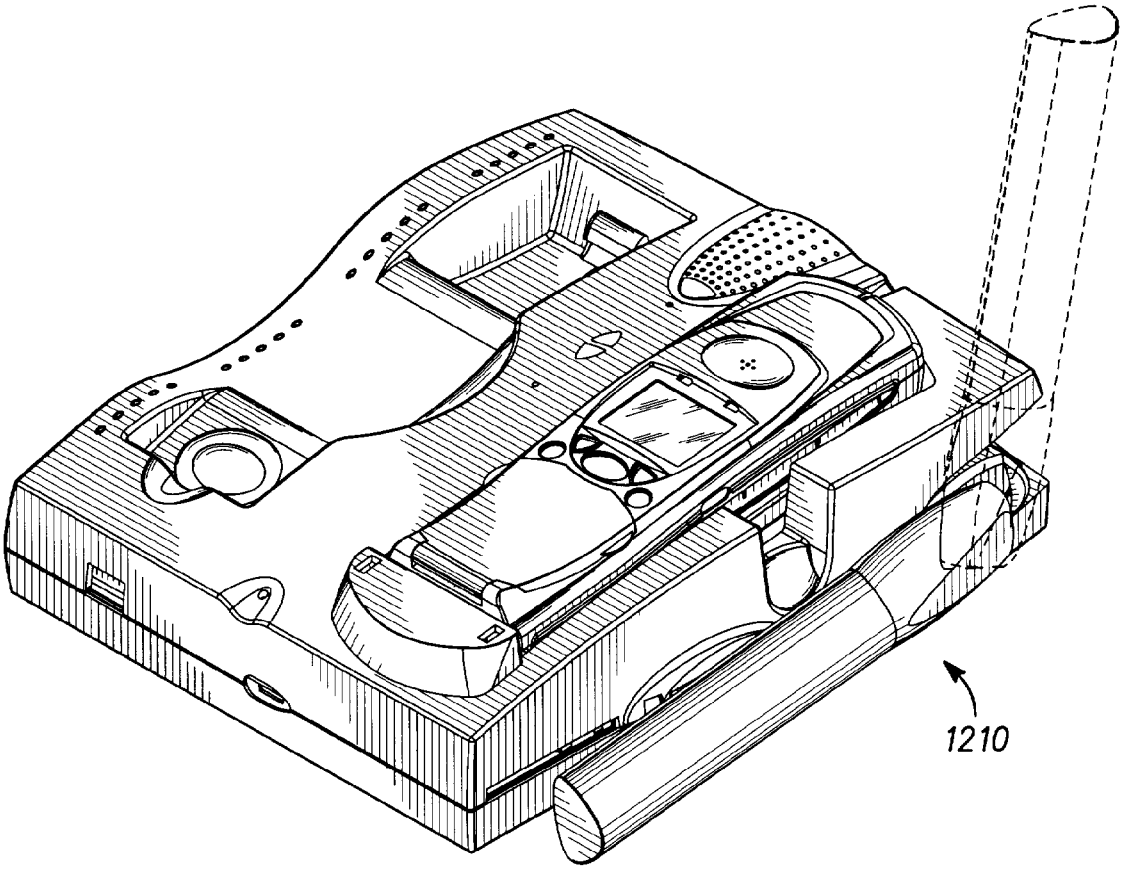
FIG. 12 is a perspective view of the docking accessory with the coupler in the rotated position and an SSU handset and antenna coupled thereto.

When the latch detent mechanism 360 is fully assembled, it is used in conjunction with the first raised wall 806 of the antenna stem 800 to maintain the antenna 1210 in a stowed (or inactive) position (shown in solid lines in FIG. 12) or a deployed (or active) position (shown in dotted lines in FIG. 12).

Figure 9:
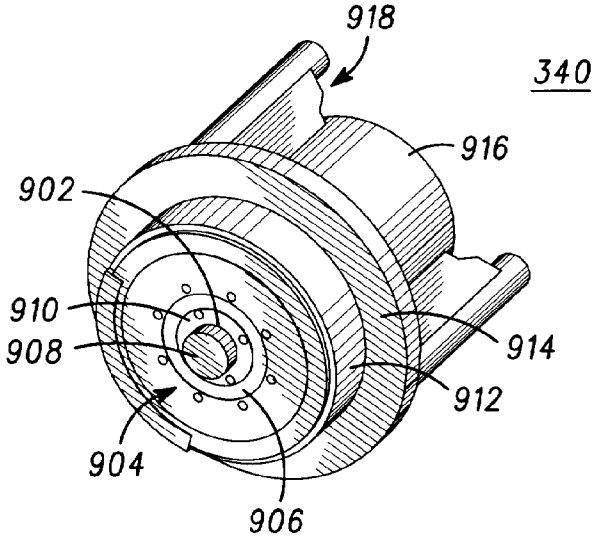
FIG. 9 is a perspective view of the second connector shown in FIG. 3.

FIG. 9 shows the second connector 340. The second connector 340 is preferably injection molded using a plateable and a non-plateable plastic according to a process known in the art. The second connector 340 includes a center conductor 902 and an outer conductor 904 in concentric relation to one another. The center conductor 902 and outer conductor 904 are separated by a circular non-conductive surface 906. The center conductor 902 includes a head 908, a shoulder 910 and a stem (not shown). The outer conductor 904 includes a first cylindrical portion 912, a disc 914 having a diameter greater than the first cylindrical portion 912 and a second cylindrical portion 916 having a diameter less than the first cylindrical portion 912. A plurality of legs 918 are coupled to the outer surface of the second cylindrical portion 916 and the bottom side of the disc 914.

FIG. 4. shows coupler 130 in a first position (unrotated position illustrated in dotted lines) with respect to the accessory 100 (FIG. 1) and a second position (rotated position illustrated in solid lines). Formed on one end of the exterior of the bottom housing 350 is a cam 410 that fits into a pocket 412 of the lower housing 120 of the accessory 100. This feature allows the coupler 130 to be rotated from the first position to the second position as shown in FIG. 4. When the coupler is rotated from the first position to the second position, the cam moves from one detent position in the accessory pocket to another detent position in the accessory pocket. FIG. 4 shows the translation distance associated with full rotation. Preferably, this distance is 6.0 mm.

Figure 5:
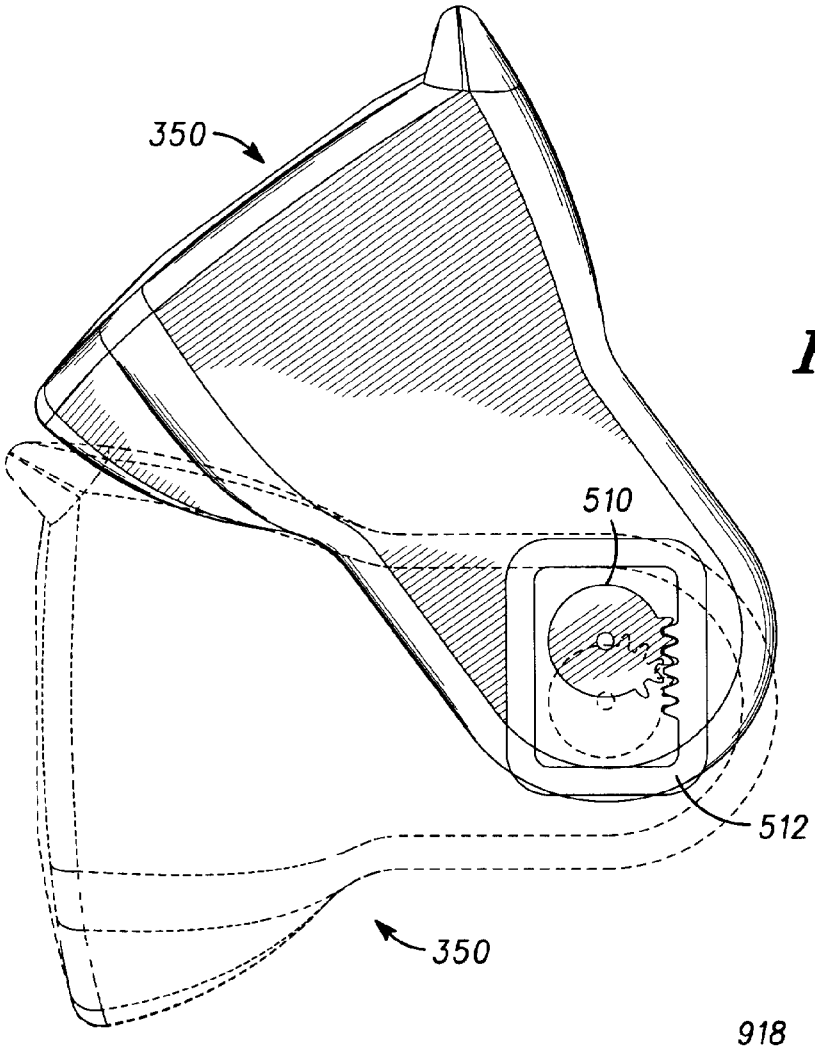
FIG. 5 is a rear view of the rotating antenna coupler mating with the docking accessory wherein a rack and pinion arrangement for moving the coupler from an unrotated position (shown in dotted) to a rotated position (shown in solid) is illustrated.

FIG. 5 shows an alternate embodiment for accomplishing rotation of the coupler 130 with respect to the accessory 100. Instead of the cam and pocket feature described above and shown in FIG. 4, a rack and pinion mechanism can be implemented. As shown in FIG. 5, a pinion gear 510 can be formed on one end of the exterior of the bottom housing 350 of the coupler 130 and a rack gear 512 can be formed on the lower housing 120. The rack and pinion feature would allow the coupler to be rotated from the first position to the second position as the pinion gear 510 travels along the rack gear 512 as shown in FIG. 5.

Figure 11:
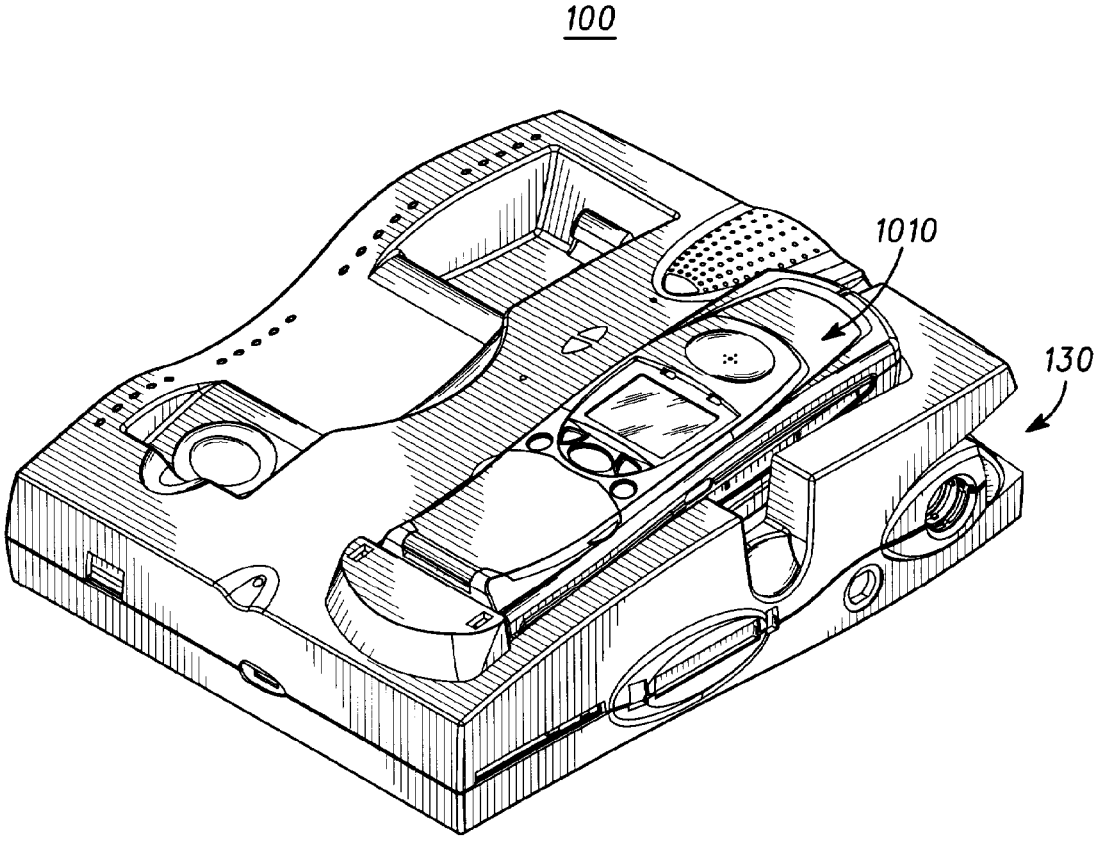
FIG. 11 is a perspective view of the docking accessory with the coupler in the rotated position and an SSU handset coupled thereto.

The operation of the rotating antenna coupler 130 will now be described. As shown in FIG. 10, the coupler 130 is disposed between the upper housing 110 and lower housing 120 of the accessory 100 such that the socket 313 with first connector 320 disposed therein extends through the slot 113. When the antenna coupler 130 is in the first position as shown in FIG. 10, the first connector 320 is located at the top end (not shown) of the slot 113. In this position, the SSU handset 1010 can be placed in the first recess 112 and coupled to the first connector 320. Rotation of the coupler 130 from the first position to the second position as shown in FIG. 11, simultaneously causes the first connector 320 to translate from the top end of the slot 113 to the bottom end 1012 (FIG. 10) of the slot 113 and causes the handset 1010 to move in the recess 112 in a direction perpendicular to the coupler's axis of rotation until the second power/data connector 1014 of the handset 1010 is coupled to the first power/data connector 115 of the accessory 100. When the power/data connectors 115, 1014 are coupled, the handset 1010 is securely locked in the recess 112 of the accessory 100.

Once the handset 1010 is secured in the recess 112, the SSU's antenna 1210 or a different antenna (not shown) can be coupled to the second connector 340 of the coupler 130, as shown in FIG. 12. The antenna 1210 (FIG. 12) in its stowed position is shown in solid lines. The antenna 1210 must be rotated to a deployed position, shown in dotted lines, before a user can place a call using the SSU or receive an incoming call.

The present invention provides a unique way of providing an RF connection to the antenna port of the SSU handset 1010 while simultaneously making power/data connections between the handset 1010 and the accessory 100. Once the handset 1010 is connected to the accessory 100, the original SSU antenna 1210, a different antenna, or a low loss cable to an external antenna may be used. After the electrical connections to the SSU handset 1010 have been made, the mating surfaces of the coupler 130 and handset 1010 are such that the handset 1010 will engage or disengage the coupler 130 only when the coupler 130 is in the unrotated position. Further, when the handset 1010 is translated downward in the accessory recess 112 to make the power/data connection, tabs 119 (FIG. 1) in the recess 112 engage openings (not shown) in the handset 1010 to secure the handset 1010 to the accessory 100.

Those skilled in the art will recognize that various modifications and variations can be made in the apparatus of the present invention and in construction of this apparatus without departing from the scope or spirit of this invention.

What is claimed is:

1. An antenna coupler comprising:

a top housing forming a first opening;

a first connector at least partially extending through the opening;

a second connector coupled to the first connector;

an antenna latch detent mechanism coupled to the second connector; and a bottom housing that mates with the top housing in a manner which forms a bore in which the second connector is at least partially received.

2. The antenna coupler of claim 1 wherein a socket is formed about the first opening.

3. The antenna coupler of claim 1 wherein a cam is formed on the bottom housing.

4. An accessory having a first power/data connector for docking a handset of a subscriber unit and providing connection to an antenna, the handset having a second power/data connector, the accessory comprising:

an upper housing having a first recess;

an antenna coupler rotatably coupled to the upper housing, wherein the coupler comprises a top housing forming a first opening, a first connector at least partially extending through the opening, a second connector coupled to the first connector, an antenna latch detent mechanism coupled to the second connector, and a bottom housing that mates with the top housing in a manner which forms a bore in which the second connector is at least partially received; and a lower housing coupled to the antenna coupler and the upper housing.

5. The accessory of claim 4 wherein when the coupler is in a first position with respect to the upper and lower housings, the handset can be received in the recess and coupled to the coupler.

6. The accessory of claim 5 wherein rotation of the coupler about an axis from the first position to a second position, displaces the handset a predetermined distance in a direction perpendicular to the axis in a manner that causes the second power/data connector to mate with the first power/data connector.

7. The accessory of claim 6 wherein the handset is locked into the accessory when the second power/data connector mates with the first power/data connector.

8. The accessory of claim 4 wherein the antenna coupler comprises:

a top housing forming a first opening;

a first connector at least partially extending through the opening;

a second connector coupled to the first connector;

an antenna latch detent mechanism coupled to the second connector; and a bottom housing that mates with the top housing in a manner which forms a bore in which the second connector is at least partially received.

9. The accessory of claim 4 wherein the first connector is coupled to the second connector by a coaxial cable.

10. The accessory of claim 4 wherein the first recess defines a slot having a top end and a bottom end, the first connector disposed through the slot.

11. The accessory of claim 10, the handset further comprising an aperture, wherein when the first connector is located at the top end of the slot, the aperture of the handset mates with the first connector such that the handset is received in the recess.

12. The accessory of claim 11 wherein linear translation of the first connector from the top end of the slot to the bottom end of the slot causes the second power/data connector to mate with the first power/data connector.

13. The accessory of claim 12 wherein the handset is locked into the accessory when the second power/data connector mates with the first power/data connector.

14. The accessory of claim 11 wherein the lower housing forms a pocket and the bottom housing forms a cam, and movement of the cam from one detent position in the pocket to another detent position in the pocket causes the second power/data connector of the handset to mate with the first power/data connector of the accessory.

15. The accessory of claim 11 wherein a rack gear is carried on the lower housing and a pinion gear is carried on the bottom housing and rotation of the coupler from a first position to a second position causes the pinion gear to travel along the rack gear until the second power/data connector of the handset mates with the first power/data connector of the accessory.

* * * * *